US009176432B2

(12) United States Patent
Sandler et al.

(10) Patent No.: US 9,176,432 B2
(45) Date of Patent: Nov. 3, 2015

(54) IMAGING SYSTEM AND METHOD

(71) Applicant: Hewlett-Packard Development Company, L.P., Houston, TX (US)

(72) Inventors: Mark Sandler, Rehovot (IL); Shai Lior, Rehovot (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 0 days.

(21) Appl. No.: 14/623,019

(22) Filed: Feb. 16, 2015

(65) Prior Publication Data

US 2015/0160586 A1 Jun. 11, 2015

Related U.S. Application Data

(63) Continuation of application No. 13/259,108, filed as application No. PCT/US2010/023277 on Feb. 5, 2010, now Pat. No. 8,985,022.

(51) Int. Cl.

| | |
|---|---|
| ***B41F 3/34*** | (2006.01) |
| ***G03G 15/10*** | (2006.01) |
| ***G03G 15/16*** | (2006.01) |

(52) U.S. Cl.

CPC ..... *G03G 15/10* (2013.01); *G03G 15/162* (2013.01); *G03G 15/1605* (2013.01)

(58) Field of Classification Search

CPC ..... G03G 15/10
USPC ..... 101/492
See application file for complete search history.

(56) References Cited

U.S. PATENT DOCUMENTS

| | | | | |
|---|---|---|---|---|
| 4,796,048 | A | 1/1989 | Bean | |
| 5,585,905 | A | 12/1996 | Mammino et al. | |
| 6,108,021 | A * | 8/2000 | Morikawa et al. | 347/221 |
| 6,256,051 | B1 | 7/2001 | Asada et al. | |
| 6,341,208 | B1 * | 1/2002 | Liu et al. | 430/108.11 |
| 2002/0067931 | A1 | 6/2002 | Ishii et al. | |
| 2003/0066751 | A1 | 4/2003 | May et al. | |
| 2004/0190941 | A1 * | 9/2004 | Thornton et al. | 399/159 |
| 2005/0142471 | A1 * | 6/2005 | Baker et al. | 430/47 |
| 2007/0019997 | A1 | 1/2007 | Lior et al. | |

FOREIGN PATENT DOCUMENTS

| | | |
|---|---|---|
| EP | 0742496 | 11/1996 |
| JP | 2003280397 A | 10/2003 |

OTHER PUBLICATIONS

European Search Report for P201758EP mailed on Sep. 30, 2014.
International Search Report for PCT/US2010/023277 mailed on Oct. 28, 2010.

* cited by examiner

*Primary Examiner* — Anthony Nguyen

(57) ABSTRACT

An intermediate transfer member (34) (ITM) transfers ink solids from an image bearing surface to a substrate. The ITM has an outermost surface having an absorptivity of less than or equal to about 5 percent when measured after 36 hours of immersion in Isopar L at 100 degrees Celsius. An imaging liquid developer system (22) deposits the ink solids and an ink solids carrier onto the outermost surface of the ITM, wherein the imaging liquid developer system (22) is configured to supply the ink solids carrier at a reduced thickness or reduced density as compared to more absorptive ITMs.

20 Claims, 7 Drawing Sheets

IMAGING SYSTEM AND METHOD

CROSS-REFERENCE TO RELATED APPLICATIONS

The present application is a continuation application of co-pending U.S. patent application Ser. No. 13/259108 filed on Sep. 22, 2011 by Sandler et al. and entitled IMAGING SYSTEM AND METHOD, which is a 371 of international PCT/US2010/023277 filed on Feb. 5, 2010 by Sandler et al. and entitled IMAGING SYSTEM AND METHOD, the full disclosures of which are hereby incorporated by reference.

BACKGROUND

Some imaging systems form images using ink or imaging solids which are carried by a liquid carrier. Consumption of the liquid carrier and recovery of unused liquid carrier may increase printing cost and complexity.

DETAILED DESCRIPTION OF THE EXAMPLE EMBODIMENTS

Figure 1:
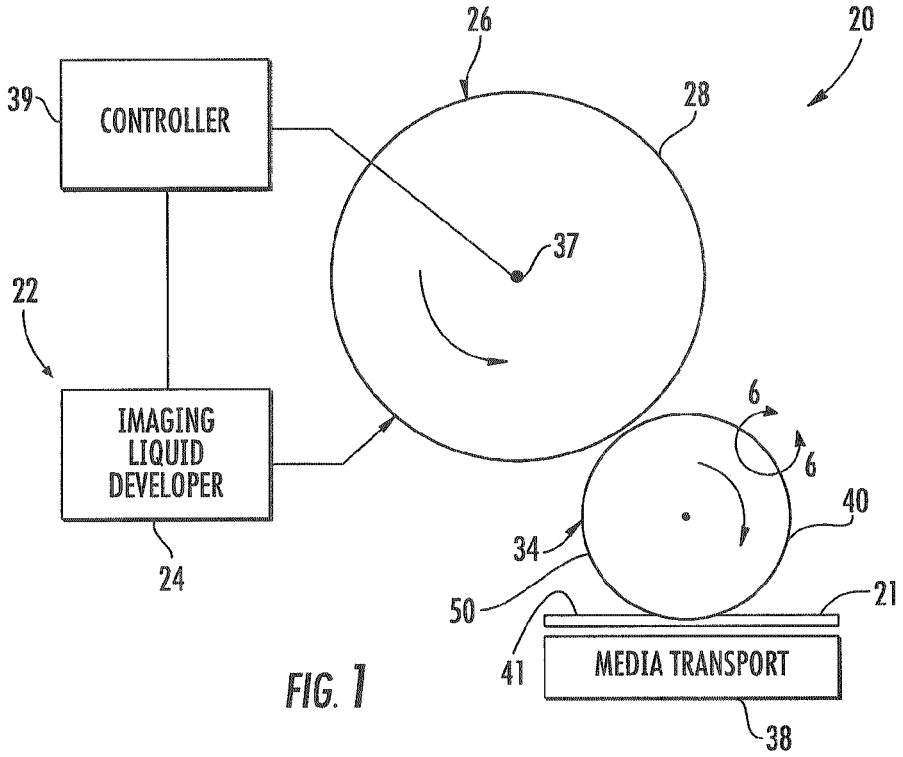
FIG. 1 is a schematic illustration of an imaging system according to an example embodiment.

FIG. 1 schematically illustrates imaging system or printer 20 according to an example embodiment. Printer 20 forms images upon a print medium 21 using an electrostatically charged imaging liquid such as a liquid toner or ink having a liquid carrier or oil carrying the ink or imaging pigments or solids. As will be described hereafter, printer 20 includes an intermediate transfer member 34 having an outer most surface 50 that receives differently colored layers of pigment containing material from an imaging liquid developer system and that transfers the layers of pigment containing material to the substrate or print medium 21. The outermost surface 50 is substantially non-absorbent with regard to the liquid carrier, having an absorptivity of less than or equal to about 5 percent when measured after 36 hours of immersion in Isopar L at 100 degrees Celsius. The low absorptivity of surface 50 facilitates printing with lower levels or amounts of liquid carrier, reducing liquid carrier consumption and recovery costs.

Printer 20 includes imaging liquid developer system 22 including imaging liquid developer 24 and imaging member 26, intermediate transfer member 34, media transport 38 and controller 39. Imaging liquid developer 24 comprises a mechanism configured to form or develop at least portions of graphic, text or an image on imaging surface 28 of imaging member 26 by selectively applying imaging liquid, including imaging material, marking materials, monochromatic or chromatic particles or toner carried by a liquid carrier or oil, to surface 28. In the example illustrated, developer 24 sequentially applies different layers of the imaging liquid including both a liquid carrier and imaging solids. In other words, developer 24 first applies a first layer of imaging liquid to imaging surface 28, wherein imaging surface 28 transfers the first layer of imaging liquid to intermediate transfer member 34 prior to developer 24 applying a second different layer of imaging liquid having different imaging solids to imaging surface 28.

According to one example embodiment, developer 24 comprises a plurality of rollers, each of the rollers dedicated to selectively applying a different imaging liquid carrying a different imaging material and to forming a different layer of imaging liquid on surface 28. In one embodiment, each roller of developer 24 transfers and applies electrostatically charged imaging liquid to imaging surface 28. The imaging liquid includes a carrier liquid and an ink (also known as colorant particles or toner particles). The carrier liquid comprises an ink carrier oil, such as Isopar L a synthetic iso-paraffin made by Exxon, or other low or medium molecular weight hydrocarbon oil. The carrier liquid may include other additional components such as a high molecular weight oil, such as mineral oil, a lubricating oil and a defoamer. In one embodiment, the liquid carrier liquid and colorant particles or imaging material comprises HEWLETT-PACKARD ELECTRO INK commercially available from Hewlett-Packard. In other embodiments, the imaging liquid may comprise other imaging liquids.

Imaging member 26 comprises a member supporting imaging surface 28. Imaging surface 28 (sometimes referred to as an imaging plate) comprises a surface configured to have one or more electrostatic patterns or images formed thereon and to have electrostatically charged imaging material, part of the imaging liquid, applied thereto. The imaging material adheres to selective portions of imaging surface 28 based upon the electrostatic images on surface 28 to form imaging material images on surface 28. The imaging material images are then subsequently transferred to intermediate transfer member 34.

In the example illustrated, imaging member 26 comprises a drum configured be rotated about axis 37. In other embodiments, imaging member 26 may comprise a belt or other supporting structures. In the example illustrated, surface 28 comprises a photoconductor or photoreceptor configured to be charged and have portions selectively discharged in response to optical radiation such that the charged and discharged areas form the electrostatic images. In other embodiments, surface 28 may be either selectively charged or selectively discharged in other manners. For example, ionic beams or activation of individual pixels along surface 28 using transistors may be used to form electrostatic images on surface 28.

In the embodiment illustrated, imaging surface 28 comprises a photoconductive polymer. In one embodiment, imaging surface 28 has an outermost layer with a composition of a polymer matrix including charge transfer molecules (also known as a photoacid). In on embodiment, the matrix may comprise a polycarbonate matrix including a charge transfer molecule that in response to impingement by light, generates an electrostatic charge that is transferred to the surface. In other embodiments, imaging surface 28 ay comprise other photoconductive polymer compositions.

Intermediate transfer member 34 comprises a member configured to receive imaging liquid 40 from imaging surface 28 and to transfer imaging material contained in the imaging liquid onto print medium 21. Intermediate image transfer member 34 has an outer most surface 50 that receives differently colored layers of pigment containing material from an imaging liquid developer system and that transfers the layers of pigment containing material to the substrate or print medium 21. The outermost surface 50 has an absorptivity of less than or equal to about 5 percent when measured after 36 hours of immersion in Isopar L at 100 degrees Celsius. The low absorptivity of surface 50 facilitates printing with lower levels or amounts of liquid carrier, reducing liquid carrier consumption and recovery costs.

Figure 2:
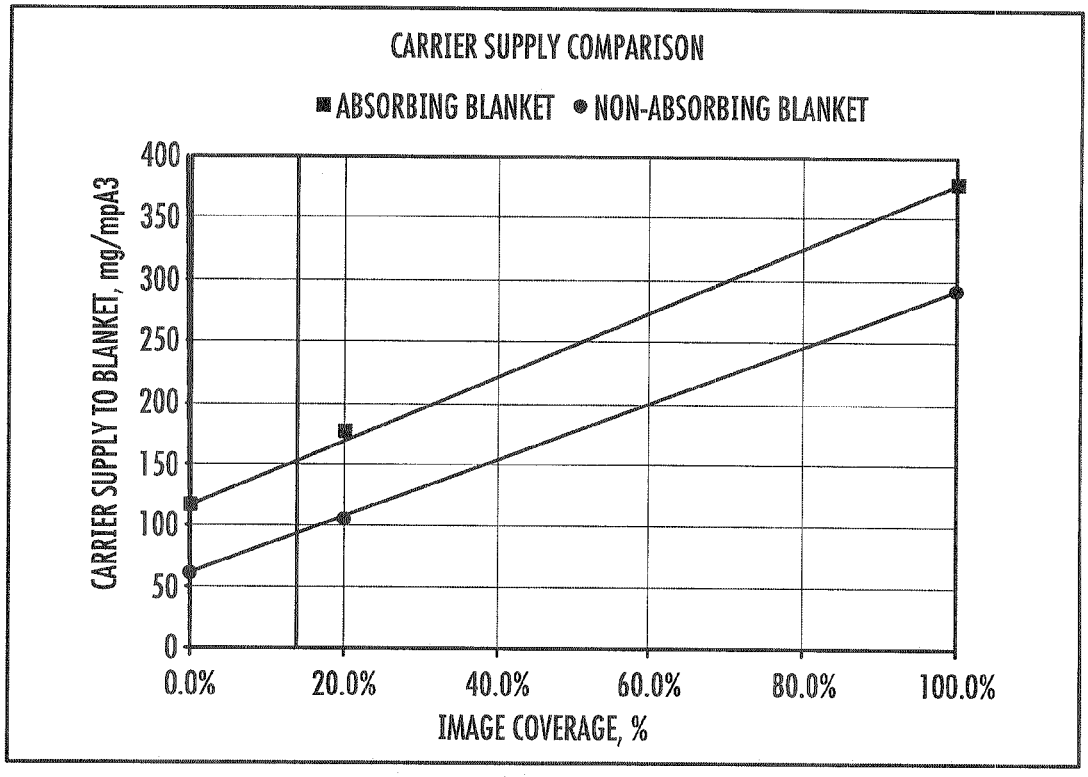
FIG. 2 is a graph illustrating a relationship between supply of a liquid carrier in a system with an absorbent intermediate transfer member and a non-absorbent intermediate transfer member.

FIGS. 2-5 illustrate an example of how the low absorptivity of surface 50 (shown in FIG. 1) may facilitate printing with less liquid carrier. FIG. 2 is a graph comparing the amount of liquid carrier that must be added, provided or supplied to intermediate transfer member by imaging liquid developer 24 through imaging surface 28 to replace consumed liquid carrier during printing of an image of a certain quality or optical density on print media 21 using (A) an intermediate transfer member having an absorbent blanket for silicone having a liquid carrier (Isopar) absorptivity of about 100% when immersed in the liquid carrier for 36 hours at 100° C. or (B) an intermediate transfer member having an absorbent blanket for silicone having a liquid carrier (Isopar) absorptivity of less than or equal to about 5 percent when immersed in the liquid carrier for 36 hours at 100° C. As shown by FIG. 2, when intermediate transfer member 34 includes a non-absorbent blanket or a blanket having an absorptivity of less than or equal to about 5 percent when immersed in the liquid carrier for 36 hours at 100° C., imaging system 22 (shown in FIG. 1) prints similar quality images upon print media 21 using substantially less liquid carrier.

As further shown by FIG. 2, the amount of liquid carrier at a supply to replace consumed liquid carrier varies depending upon the percent of image coverage upon print medium 21 (shown in FIG. 1). Background areas or non-image areas are those areas of print medium 21 which lack any printing or image. Image areas are those portions of print medium 21 which are entirely coated or covered with imaging solids. As indicated by the graph FIG. 2, imaging liquid developer 24 is configured to supply the ink solid to liquid carrier at a rate of less than or equal to about 350 mg/lmpA3 (ImpA3 means one impression of A3 size, where the impression is one printing cycle with single ink) when print medium 21 is to be printed with 100% image coverage, is configured to supply the liquid carrier at a rate of less than or equal to 150 mg/lmpA3 when print medium 21 is to be printed with 20% image coverage, and is configured to supply the liquid carrier at a rate of less than or equal to 100 mg/lmpA3 when print medium 21 is to be printed with 0% image coverage. The vertical line indicates the amount of liquid care supplied by imaging liquid developer 24 at an average 15% image coverage.

Figure 3:
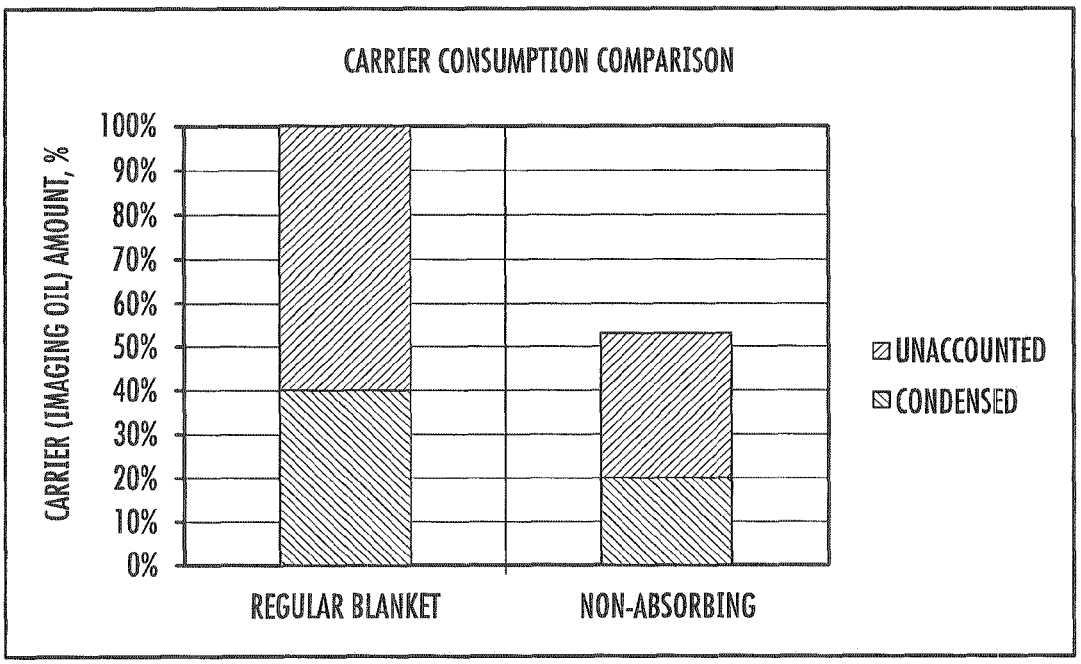
FIG. 3 is a graph illustrating liquid carrier consumption in a system with an absorbent intermediate transfer member and a non-absorbent intermediate transfer member.

FIG. 3 is a bar graph comparing the amount of liquid carrier consumed and which is replaced by image in liquid developer 24 when imaging system 20 uses (A) an intermediate transfer member having an absorbent blanket for silicone having a liquid carrier (Isopar) absorptivity of about 100% when immersed in the liquid carrier for 36 hours at 100° C. or (B) an intermediate transfer member having an absorbent blanket for silicone having a liquid carrier (Isopar) absorptivity of less than or equal to about 5 percent when immersed in the liquid carrier for 36 hours at 100° C. As shown by FIG. 3, because intermediate transfer member 34 of imaging system 20 includes a non-absorbing outermost surface 50, the amount of liquid carrier consumed or unaccounted for is greatly reduced. In addition, the amount of liquid carrier that is condensed and recovered is also greatly reduced. As a result, in other liquid carrier that must be continuously supplied or replaced by imaging liquid developer 24 is reduced, reducing material supply costs. In addition, less volatized liquid carrier (VOC) is discharged or emitted by imaging system 20 to the environment to reduce the impact of imaging system 20 upon the environment.

Because less liquid carrier is condensed and recovered, imaging system 20 may utilize simpler and less complex VOC emission capture, recovery and control systems. In addition, imaging system 20 consumed less energy in evaporating and later condensing the liquid carrier to recover the liquid carrier. In particular, imaging system 20 is able to decrease energy consumption through decreased heating, blowing and cooling of airflow.

Figure 4:
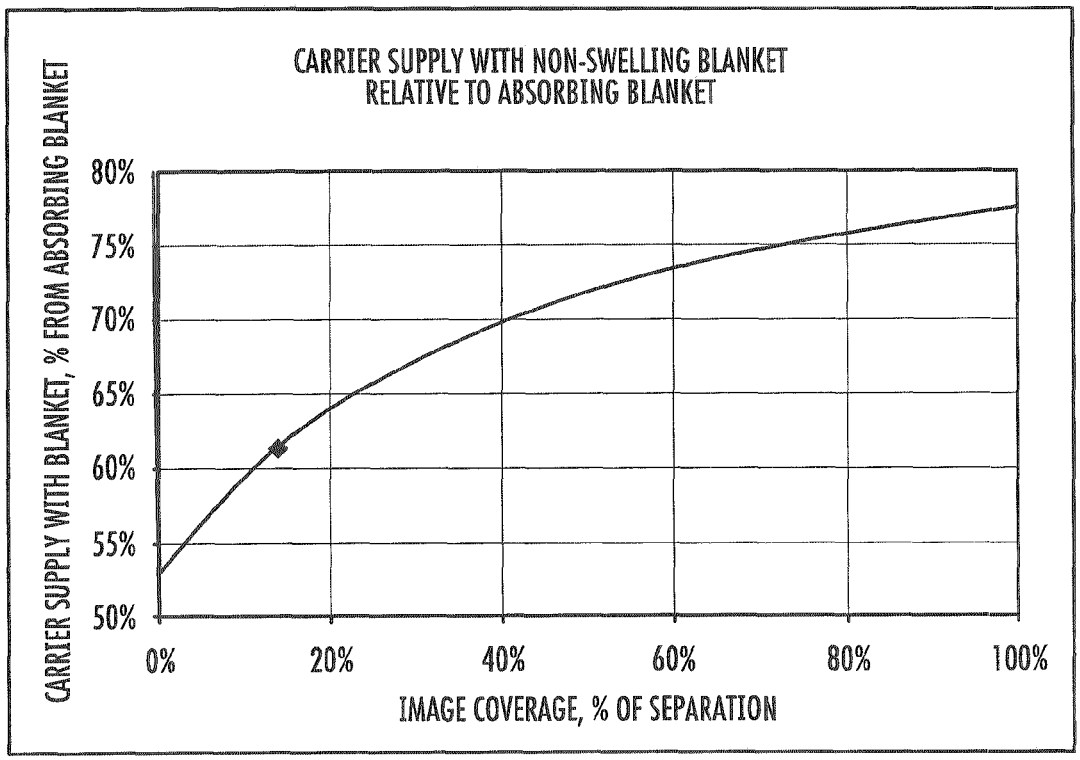
FIG. 4 is a graph illustrating supply of liquid carrier or oil to a non-swelling or non-absorbent intermediate transfer member blanket as compared to the supply of liquid carrier to an absorbent intermediate transfer member blanket according to an example embodiment.
Figure 5:
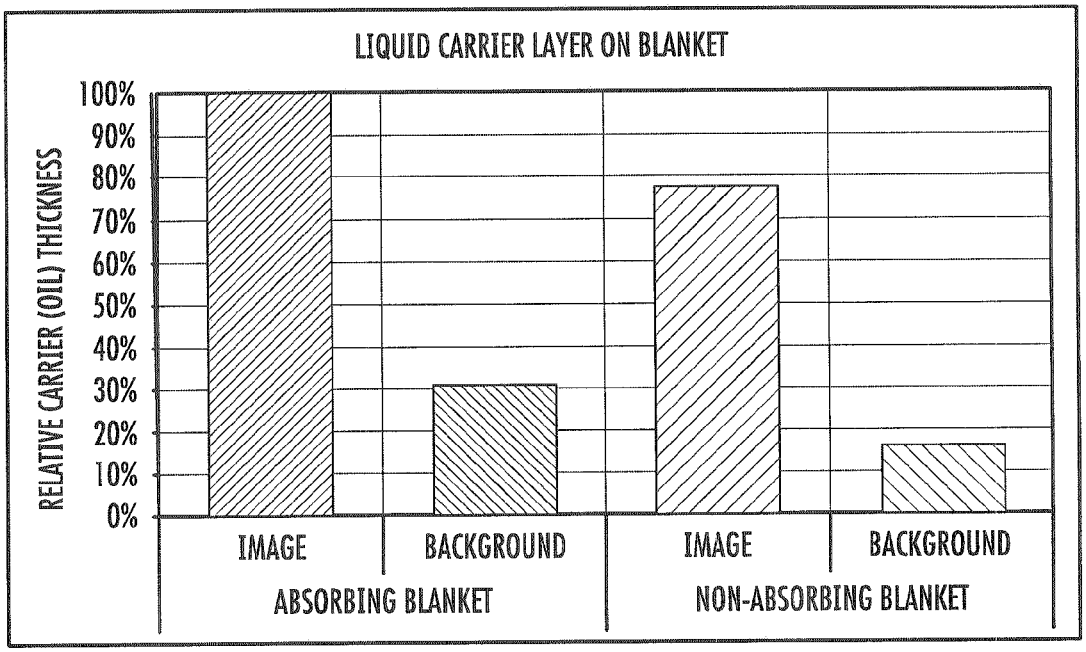
FIG. 5 is a graph illustrating a thickness of the liquid carrier or oil layer on imaging and background portions of a non-absorbing intermediate transfer member blanket as compared to a thickness of the liquid carrier on imaging and background portions of an absorbent intermediate transfer member blanket according to an example embodiment.

FIGS. 4 and 5 further graphically illustrate and compare use of an absorbent blanket or outer surface on intermediate transfer member 34 (shown in FIG. 1) with the use of the relatively non-absorbent blanket (i.e. a blanket having less than 5% to absorptivity when immersed in the liquid carrier for 36 hours at 100° C.). FIG. 4 is a line graph illustrating the lesser amount of liquid carrier supplied by imaging liquid developer 24 when imaging system 20 utilizes the non-absorbing blanket. FIG. 5 is a bar graph illustrating the reduction in the equivalent thickness of the liquid carrier (oil) form by developer system 22 upon intermediate transfer member 34. As shown by FIG. 5, developer system 22 supplies or forms a carrier or oil layer on outermost surface 50 having a reduced thickness as compared the thickness of the carrier layer that developer system 22 would otherwise form on the outermost surface of an intermediate transfer member having an absorbing blanket. As further shown by FIG. 5, the equivalent thickness of the carrier or oil layer formed by developer system 22 upon intermediate transfer member 34 is reduced on circumferential surface portions of intermediate transfer member 34 corresponding to both the image portions as well as the non-image or background portions.

According to one embodiment, developer system 22 forms an oil or carrier layer thickness upon intermediate transfer member 34 having a thickness of less than 3.5 μm and nominally between about 3 μm and 3.4 μm at image areas. According to one embodiment, developer system 22 further forms an oil or carrier layer thickness upon intermediate transfer member 34 having a thickness of less than 1.0 μm and nominally between about 0.5 μm and 0.6 μm at non-image areas. One embodiment, the oil or chair lay her thickness of less than 0.6 μm. In other embodiments other oil or carrier thicknesses may be formed.

Figure 6:
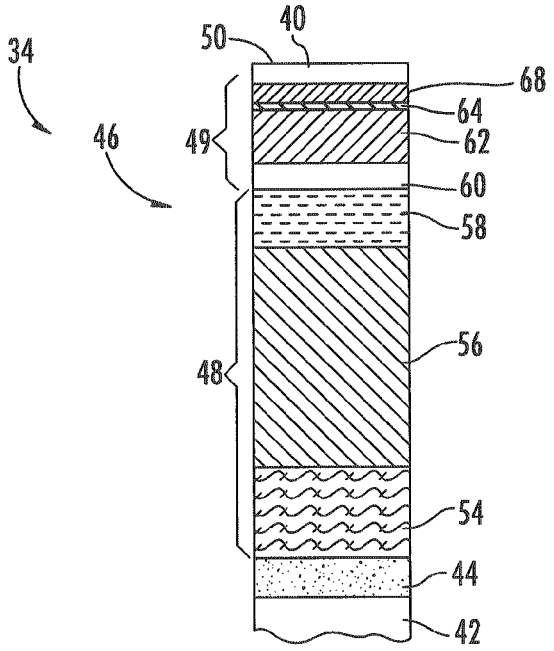
FIG. 6 is an enlarged fragmentary sectional view of a portion of an intermediate transfer member of the imaging system of FIG. 1 according to an example embodiment.

FIG. 6 is an enlarged fragmentary view of a portion of an example intermediate transfer member 34 carrying at least one layer of imaging material 42 prior to the release of the layers onto print medium 21. In the example illustrated, intermediate transfer member 34 includes support 42, adhesive layer 44, and blanket 46 including blanket body 48 and image transfer portion 49 which provides the outer most surface 50. Support 42 comprises a structure serving as a foundation for blanket 46. In one embodiment in which image forming portion 46 is heated through support 42, such as with an internal halogen lamp heater or other heater, support 42 may be formed from one more materials having a high degree of thermal conductivity. In other embodiments, blanket 46 can be heated from outside using hot air or IR heater, for example. In the example illustrated, support 42 comprises a drum. In other embodiments, support 42 may comprise a belt or other supporting structure.

Adhesive layer 44 secures blanket 46 to support 42. Adhesive layer 44 may have a variety of compositions which are compatible with innermost surface of blanket 46 and the outer surface of support 42. In other embodiments, blanket 46 may be secured to support 42 in other manners.

Blanket body 48 of blanket 46 extends between support 42 and image transfer portion 49 of blanket 46. Blanket body 48 comprises one or more layers of materials configured to provide compressibility for blanket 46. In the example illustrated, blanket body 48 includes fabric layer 54, compressible layer 56, and top layer 58. Fabric layer 54 comprises a layer of fabric facilitating the joining of blanket body 48 to support 42. In one embodiment, fabric layer 54 comprises a woven NOMEX material having a thickness of about 200 μm. In embodiments where intermediate image transfer member 34 is externally heated and omits internal heating, fabric layer 54 may be formed from other less heat resistant fabrics or materials.

Compressible layer 56 comprises one or more layers of one or more materials having a relatively large degree of compressibility. In one embodiment, compressible layer 56 comprises 400 μm of saturated nitrile rubber loaded with carbon black to increase its thermal conductivity. In one embodiment, layer 56 includes small voids (about 40 to about 60% by volume).

Top layer 58 serves as an intermediate layer between compressible layer 56 and image transfer portion 49 of blanket 46. According one embodiment, top layer 58 is formed from the same material as compressible layer 56, but omitting voids. In other embodiments, top layer 58 may be formed from what more materials different than that of compressible layer 56.

According to one embodiment, blanket body 48 comprises MCC-1129-02 manufactured and sold by Reeves SpA, Lodi Vecchio, Milano, Italy. In yet another embodiment, blanket body 48 may be composed of a fewer or greater of such layers or layers of different materials.

Image forming portion 49 of blanket 46 comprise the outermost set of layers of blanket 46 which have the largest interaction with the imaging liquid and print medium 21 (shown in FIG. 1). In one embodiment, image forming portion 49 is fixed to blanket body 48. In other embodiments, image forming portion 49 of blanket 46 can be separated from the body 48 such that portion 49 and body 48 can be installed and removed separately.

Image forming portion 49 includes conductive layer 60, conforming layer 62 and priming layer 64. Conductive layer 60 overlies blanket body 48 and underlies conforming layer 62. Conductive layer 60 comprises layer one or more conductive materials in electrical contact with an allegedly conducted bar for transmitting electric current to conducting portion 60. Electrical charge supplied to conducting layer 60 results in a transfer voltage proximate the outer surface of image forming portion 49, facilitating transfer of the electrostatically charged imaging material.

In other embodiments, conductive layer 60 may be omitted such as in embodiments where layers beneath conducting layer 60 are partially conducting or wherein conforming layer 62 or release layer 50 are somewhat conductive. For example, conforming layer 56 may be made partially conductive with the addition of conductive carbon black or metal fibers. Adhesive layer 44 may be made conductive such that electric current flows directly from support 42. Conforming layer 62 and/or release layer 50 may be made somewhat conductive (between $10^6$ and $10^{11}$ ohm-cm and nominally between $10^9$ and $10^{11}$ ohm-cm) with the addition of carbon black or the addition of between 1% and 10% of antistatic compounds such as CC42 sold by Witco.

Conforming layer 62 comprises a soft conforming elastomeric layer. Conforming layer 62 provides conformation of blanket 46 to image surface 28 (shown in FIG. 1) at the low pressures used in the transfer of images of imaging liquid to blanket 46. In one embodiment, conforming layer 62 comprises a polyurethane or acrylic having a Shore A hardness of less than about 65. In one embodiment, conforming layer 62 has a hardness of less than about 55 and greater than about 35. In other embodiments, conforming layer 62 may have a suitable hardness value of between about 42 and about 45.

Priming layer 64 comprises a layer configured to facilitate bonding or joining of release layer 50 to conforming layer 62. According to one embodiment, primary layer comprises a primer such as 3-glycidoxypropyl) trimethoxysilane 98% (ABCR, Germany), a silane based primer or adhesion promoter, a catalyst such as Stannous octoat (Sigma) and a solvent such as Xylene (J T Baker). According to one embodiment, the catalyst solution or mixture which forms priming layer 64 is formed by dispersing a fumed silica (R972, Degussa) in the xylene using a sonicator. The solution is then mixed with the primer and the catalyst. This catalyst mixture has a working life for several hours. Primer layer 64 does not include any fillers having a particle size greater than 1 μ. In one embodiment, primer layer 64 omits all fillers. As a result, blanket 46 is less subject to abrasion. In other embodiments, primary layer 64 may include other materials or compositions.

Outermost surface 50 comprises the outermost surface of image forming portion 49. Outermost surface 50 has an absorptivity of less than or equal to about 5 percent when measured after 36 hours of immersion in Isopar at 100 degrees Celsius. In the example illustrated embodiment, surface 50 comprises the outermost surface of release layer 68 provided on priming layer 64. Release layer 68 facilitates the release of imaging material from intermediate transfer member 34 on to print medium 21. In the example of strata, layer 68, providing outermost surface 50, is formed from one mortgage or else so asked to be relatively non-absorbent as noted above. In one embodiment, layer 68 is formed from a fluoroelastomer, a fluorosilocone, a fluoroelastomer grafted with silicone, a silicone doped with fillers for controlling absorption or various combinations or derivatives thereof. In another embodiment, layer 68 is formed from a VITON fluoroelastomer commercially available from Dupont, a fluoroelastomer having similar properties to a VITON fluoroelastomer, or a perfluoropolyether backbone with a terminal silicone crosslinking group (SIFEL). In other embodiments, outermost surface 50 may be provided by other layers or other materials having the above noted absorptivity of less than or equal to about 5 percent.

Media transport 38 (shown in FIG. 1) comprise a mechanism configured to transport and position a substrate or print medium 21 opposite to intermediate image transfer member 34 such that the imaging material may be transferred from member 34 to medium 21. In one embodiment, media transport 38 may comprise a series of one or more belts, rollers and a media guides. In another embodiment, media transport 38 may comprise a drum. In the example illustrated, media transport 38 is configured to pass print medium 21 a plurality of times across intermediate transfer member 34, wherein a separate individual layer of imaging material is transferred to print medium 21 during each successive pass of print medium 21 across transfer member 34. In one embodiment, print medium 21 comprises a sheet supported by a drum which rotates multiple times to pass print medium 21 across transfer member 34 multiple times.

Controller 39 comprises one or more processing units configured to generate control signals directing the operation of imaging liquid developer 24, imaging member 26, intermediate transfer member 34 and media transport 38. For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 39 may be embodied as part of one or more application-specific integrated circuits (ASICs). Unless otherwise specifically noted, the controller is not limited to any specific combination of hardware circuitry and software, nor to any particular source for the instructions executed by the processing unit.

In operation, controller 39 generates control signals directing imaging liquid developer 24 to apply a first layer of imaging liquid, including imaging material or solids (colorant particles). As noted above, due to the electrostatic image or pattern formed upon imaging surface 28, an image of imaging material is formed on surface 28. This layer of imaging material is then transferred to intermediate image transfer member 34. Intermediate image transfer member 34 then transfers the layer of imaging material to print medium 21 during a single pass of print medium 21 by media transport 38. This process is repeated a plurality of times to stack layer upon layer of different imaging materials on print medium 21 to form the final image on print medium 21.

Because the final image is formed from multiple individual layers independently deposited upon print medium 21, such layers are extremely thin. As shown above in FIG. 3, because the outermost surface 50 of intermediate transfer member 34 is smooth, such layers may be even thinner with less pigments.

Figure 7:
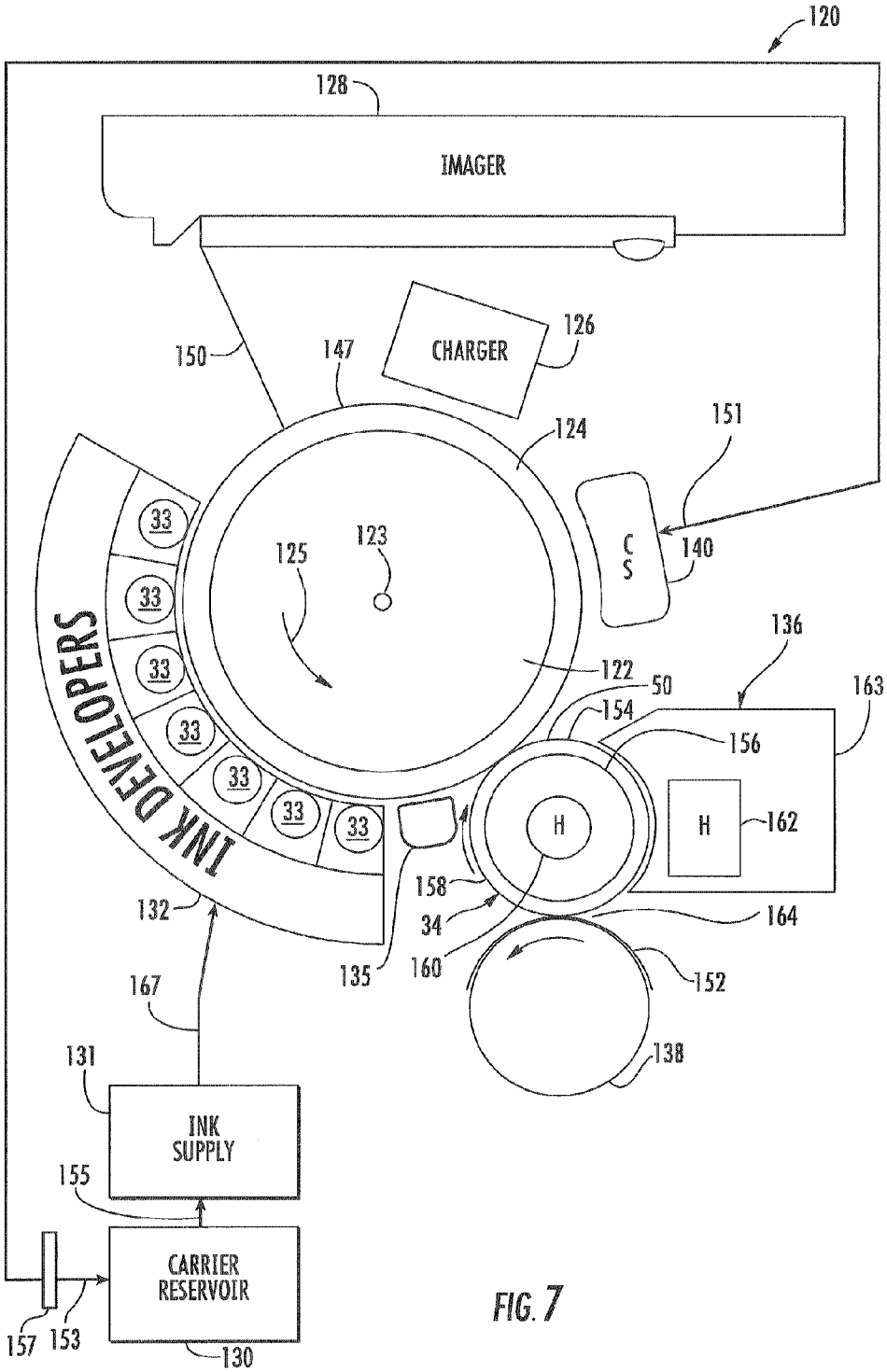
FIG. 7 is a schematic illustration of another embodiment of the imaging system of FIG. 1 according to an example embodiment.

FIG. 7 schematically illustrates printer 120, another embodiment of printer 20 shown in FIG. 1. Like printer 20, printer 120 utilizes intermediate transfer member 34 including out of more surface 50. Printer 120 comprises a liquid electrophotographic (LEP) printer. Printer 120, (sometimes embodied as part of an offset color press) includes drum 122, photoconductor 124, charger 126, imager 128, ink carrier oil reservoir 130, ink supply 131, developer 132, internally and/or externally heated intermediate transfer member 34, heating system 136, impression member 138 and cleaning station 140.

Drum 122 comprises a movable support structure supporting photoconductor 124. Drum 122 is configured to be rotationally driven about axis 123 in a direction indicated by arrow 125 by a motor and transmission (not shown). As a result, distinct surface portions of photoconductor 124 are transported between stations of printer 120 including charger 126, imager 128, ink developers 132, transfer member 34 and charger 134. In other embodiments, photoconductor 124 may be driven between substations in other manners. For example, photoconductor 124 may be provided as part of an endless belt supported by a plurality of rollers.

Photoconductor 124, also sometimes referred to as a photoreceptor, comprises a multi-layered structure configured to be charged and to have portions selectively discharged in response to optical radiation such that charged and discharged areas form a discharged image to which charged printing material is adhered.

Charger 126 comprises a device configured to electrostatically charge surface 147 of photoconductor 124. In one embodiment, charger 126 comprises a charge roller which is rotationally driven while in sufficient proximity to photoconductor 124 so as to transfer a negative static charge to surface 147 of photoconductor 124. In other embodiments, charger 126 may alternatively comprise one or more corotrons or scorotrons. In still other embodiments, other devices for electrostatically charging surface 147 of photoconductor 124 may be employed.

Imager 128 comprises a device configured to selectively electrostatically discharge surface 147 so as to form an image. In the example shown, imager 128 comprises a scanning laser which is moved across surface 147 as drum 122 and photoconductor 124 are rotated about axis 123. Those portions of surface 147 which are impinged by light or laser 150 are electrostatically discharged to form an image (or latent image) upon surface 147. In other embodiments, imager 128 may alternatively comprise other devices configured to selectively emit or selectively allow light to impinge upon surface 147. For example, in other embodiments, imager 128 my alternatively include one or more shutter devices which employ liquid crystal materials to selectively block light and to selectively allow light to pass to surface 147. In yet other embodiments, imager 128 may alternatively include shutters which include micro or nano light-blocking shutters which pivot, slide or otherwise physically move between a light blocking and light transmitting states.

Ink carrier reservoir 130 comprises a container or chamber configured to hold ink carrier oil for use by one or more components of printer 120. In the example illustrated, ink carrier reservoir 130 is configured to hold ink carrier oil for use by cleaning station 140 and ink supply 131. In one embodiment, as indicated by arrow 151, ink carrier reservoir 130 serves as a cleaning station reservoir by supplying ink carrier oil to cleaning station 140 which applies the ink carrier oil against photoconductor 124 to clean the photoconductor 124. In one embodiment, cleaning station 140 further cools the ink carrier oil and applies ink carrier oil to photoconductor 124 to cool surface 147 of photoconductor 124. For example, in one embodiment, cleaning station 140 may include a heat exchanger or cooling coils in ink care reservoir 130 to cool the ink carrier oil. In one embodiment, the ink carrier oil supply to cleaning station 140 further assists in diluting concentrations of other materials such as particles recovered from photoconductor 124 during cleaning.

After ink carrier oil has been applied to surface 147 to clean and/or cool surface 147, the surface 147 is wiped with an absorbent roller and/or scraper. The removed carrier oil is returned to ink carrier reservoir 130 as indicated by arrow 153. In one embodiment, the ink carrier oil returning to ink carrier reservoir 130 may pass through one or more filters 157 (schematically illustrated). As indicated by arrow 155, ink carrier oil in reservoir 130 is further supplied to ink supply 131. In other embodiments, ink carrier reservoir 130 may alternatively operate independently of cleaning station 140, wherein ink carrier reservoir 130 just supplies ink carrier oil to ink supply 131.

Ink supply 131 comprises a source of printing material for ink developers 132. Ink supply 131 receives ink carrier oil from carrier reservoir 130. As noted above, the ink carrier oil supplied by ink carrier reservoir 130 may comprise new ink carrier oil supplied by a user, recycled ink carrier oil or a mixture of new and recycling carrier oil. Ink supply 131 mixes being carrier oil received from ink carrier reservoir 130 with pigments or other colorant particles. The mixture is applied to ink developers 132 as used by ink developers 132 using one or more sensors and solenoid actuated valves (not shown).

In the particular example shown, the raw, virgin or unused printing material may comprise a liquid or fluid ink comprising a liquid carrier and colorant particles. The colorant particles have a size of less than 2 μ. In different embodiments, the particle sizes may be different. In the example illustrated, the printing material generally includes approximately 3% by weight, colorant particles or solids part to being applied to surface 147. In one embodiment, the colorant particles include a toner binder resin comprising hot melt adhesive.

In one embodiment, the liquid carrier comprises an ink carrier oil, such as Isopar, and one or more additional components such as a high molecular weight oil, such as mineral oil, a lubricating oil and a defoamer. In one embodiment, the printing material, including the liquid carrier and the colorant particles, comprises HEWLETT-PACKARD ELECTRO INK commercially available from Hewlett-Packard.

Ink developers 132 comprises devices configured to apply printing material to surface 147 based upon the electrostatic charge upon surface 147 and to develop the image upon surface 147. According to one embodiment, ink developers 132 comprise binary ink developers (BIDs) circumferentially located about drum 122 and photoconductor 124. Such ink developers are configured to form a substantially uniform 6 μ thick electrostatically charged layer composed of approximately 20% solids which is transferred to surface 147. In yet other embodiments, ink developers 132 may comprise other devices configured to transfer electrostatically charged liquid printing material or toner to surface 147.

Intermediate image transfer member 34 comprises a member configured to transfer the printing material upon surface 147 to a print medium 152 (schematically shown). Intermediate transfer member 34 includes an exterior surface 154 which is resiliently compressible and which is also configured to be electrostatically charged. Because surface 154 is resiliently compressible, surface 154 conforms and adapts to irregularities in print medium 152. Because surface 154 is configured to be electrostatically charged, surface 154 may be charged so as to facilitate transfer of printing material from surface 147 to surface 154.

As noted above with respect to imaging system 20, the outermost surface 50 (shown in FIG. 6) of intermediate image transfer member 34 has an absorptivity of less than or equal to about 5 percent when measured after 36 hours of immersion in Isopar at 100 degrees Celsius.

Heating system 136 comprises one or more devices configured to apply heat to printing material being carried by surface 154 from photoconductor 124 to medium 152. In the example illustrated, heating system 136 includes internal heater 160, external heater 162 and vapor collection plenum 163. Internal heater 160 comprises a heating device located within drum 156 that is configured to emit heat or inductively generate heat which is transmitted to surface 154 to heat and dry the printing material carried at surface 154. External heater 162 comprises one or more heating units located about transfer member 34. According to one embodiment, heaters 160 and 162 may comprise infrared heaters.

Heaters 160 and 162 are configured to heat printing material to a temperature of at least 85° C. and less than or equal to about 110° C. In still other embodiments, heaters 160 and 162 may have other configurations and may heat printing material upon transfer member 34 to other temperatures. In particular embodiments, heating system 136 may alternatively include one of either internal heater 160 or external heater 162.

Vapor collection plenum 163 comprises a housing, chamber, duct, vent, plenum or other structure at least partially circumscribing intermediate transfer member 34 so as to collect or direct ink or printing material vapors resulting from the heating of the printing material on transfer member 34 to a condenser (not shown).

Impression member 138 comprises a cylinder adjacent to intermediate transfer member 34 so as to form a nip 164 between member 34 and member 138. Medium 152 is generally fed between transfer member 34 and impression member 138, wherein the printing material is transferred from transfer member 34 to medium 152 at nip 164. Although impression member 138 is illustrated as a cylinder or roller, impression member 138 and alternatively comprise an endless belt or a stationary surface against which intermediate transfer member 34 moves.

Cleaning station 140 comprises one or more devices configured to remove any residual printing material from photoconductor 124 prior to surface areas of photoconductor 124 being once again charged at charger 126. In one embodiment, cleaning station 140 may comprise one or more devices configured to apply a cleaning fluid to surface 147, wherein residual toner particles are removed by one or more is absorbent rollers. In one embodiment, cleaning station 140 may additionally include one or more scraper blades. In yet other embodiments, other devices may be utilized to remove residual toner and electrostatic charge from surface 147.

In operation, ink developers 132 develop an image upon surface 147 by applying electrostatically charged ink having a negative charge. Once the image upon surface 147 is developed, charge eraser 135, comprising one or more light emitting diodes, discharges any remaining electrical charge upon such portions of surface 147 and ink image is transferred to surface 154 of intermediate transfer member 34. In the example shown, each of yellow (Y), cyan (C) and pigment black (K) layers including both the ink solids and the liquid carrier deposited on outer surface 50 have an initial thickness (immediately after transfer onto surface 50) on image areas of the outermost surface of less than 3.5 μm and nominally between 3 μm and 3.4 μm. The liquid carrier has an initial thickness (immediately after transfer onto surface 50) on non-image areas of the outermost surface of less than 1.0 μm and nominally less than 0.6 μm and between 0.5 and 0.6 μm.

As compared to systems having an intermediate transfer member 34 with an absorptive surface 50, imaging system or printer 120 reduces the amount of liquid carrier consumed or unaccounted. In addition, the amount of liquid carrier that is condensed and recovered is also greatly reduced. As a result, in other liquid carrier that must be continuously supplied or replaced by imaging liquid developers 132 is reduced, reducing material supply costs. In addition, less volatized liquid carrier (VOC) is discharged or emitted by imaging system 120 to the environment is lowered to reduce the impact of imaging system 120 upon the environment.

Heating system 136 applies heat to such printing material upon surface 154 so as to evaporate the carrier liquid of the printing material and to melt toner binder resin of the color and particles or solids of the printing material to form a hot melt adhesive. Thereafter, the layer of hot colorant particles forming an image upon surface 154 is transferred to medium 152 passing between transfer member 34 and impression member 138. In the embodiment shown, the hot colorant particles are transferred to print medium 152 at approximately 90° C. The layer of hot colorant particles cool upon contacting medium 152 on contact in nip 164.

These operations are repeated for the various colors for preparation of the final image to be produced upon medium 152. As a result, one color separation at a time is formed on a surface 154. This process is sometimes referred to as "multi-shot" process.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An imaging system comprising:

an intermediate transfer member (ITM) operative for transfer of ink solids from an image bearing surface for a subsequent transfer to a substrate; the ITM having an outermost surface having an absorptivity of less than or equal to about 5 percent when measured after 36 hours of immersion in Isopar L at 100 degrees Celsius; and an imaging liquid developer system operative to sequentially deposit the ink solids and an ink solids carrier onto the outermost surface of the ITM, wherein the imaging liquid developer system is configured to supply the ink solids carrier at an equivalent thickness of less than 3.5 μm at image areas.

2. The imaging system of claim 1, wherein the ink solids carrier is supplied at a rate of less than or equal to about 300 mg/lmpA3 at 100% image coverage.

3. The imaging system of claim 2, wherein the ink solids carrier is supplied at a rate of less than or equal to about 150 mg/lmpA3 at 20% image coverage.

4. The imaging system of claim 3, wherein the ink solids carrier is supplied at a rate of less than or equal to about 100 mg/lmpA3 at 0% coverage.

5. The imaging system of claim 1, wherein the ink solids carrier is supplied at a rate of less than or equal to about 150 mg/lmpA3 at 20% image coverage.

6. The imaging system of claim 5, wherein the ink solids carrier is supplied at a rate of less than or equal to about 100 mg/lmpA3 at 0% coverage.

7. The imaging system of claim 1, wherein the ink solids carrier is supplied at a rate of less than or equal to about 100 mg/lmpA3 at 0% coverage.

8. The imaging system of claim 1, wherein the imaging liquid developer system is configured to supply the ink solids carrier at an equivalent thickness of between 3 um and 3.4 um at image areas.

9. The imaging system of claim 1, wherein the imaging liquid developer system is configured to supply the ink solids carrier at a thickness of less than 1.0 um at non-image areas.

10. The imaging system of claim 9, wherein the imaging liquid developer system is configured to supply the ink solids carrier at a thickness of between 0.5 um and 0.6 um at non-image areas.

11. A method comprising:

developing one or more layers of imaging liquid on an intermediate transfer member (ITM) having an outermost surface having an absorptivity of less than or equal to about 5 percent when measured after 36 hours of immersion in Isopar L at 100 degrees Celsius, the imaging liquid including ink solids and an ink solids carrier, wherein the ink solids carrier is supplied at an equivalent thickness of less than 3.5 μm at image area; and transferring the layers from the ITM onto a print medium.

12. The method of claim 11, wherein the ink solids carrier is supplied on non-image areas of the outermost surface at a thickness of less than 0.6 um.

13. The method of claim 11, wherein the ink solids carrier is supplied at a rate of less than or equal to about 300 mg/lmpA3 at 100% image coverage.

14. The method of claim 13, wherein the ink solids carrier is supplied at a rate of less than or equal to about 150 mg/lmpA3 at 20% image coverage.

15. The method of claim 14, wherein the ink solids carrier is supplied at a rate of less than or equal to about 100 mg/lmpA3 at 0% coverage.

16. The method of claim 11, wherein the ink solids carrier is supplied at a rate of less than or equal to about 150 mg/lmpA3 at 20% image coverage.

17. The method of claim 16, wherein the ink solids carrier is supplied at a rate of less than or equal to about 100 mg/lmpA3 at 0% coverage.

18. The method of claim 11, wherein the ink solids carrier is supplied at a rate of less than or equal to about 100 mg/lmpA3 at 0% coverage.

19. An imaging system comprising:

an intermediate transfer member (ITM) operative for transfer of ink solids from an image bearing surface for a subsequent transfer to a substrate; the ITM having an outermost surface having an absorptivity of less than or equal to about 5 percent when measured after 36 hours of immersion in Isopar L at 100 degrees Celsius; and an imaging liquid developer system operative to sequentially deposit the ink solids and an ink solids carrier onto the outermost surface of the ITM, wherein the imaging liquid developer system is configured to supply the ink solids carrier at a thickness of less than 1.0 um at non-image areas.

20. The imaging system of claim 19, wherein the imaging liquid developer system is configured to supply the ink solids carrier at a thickness of between 0.5 um and 0.6 um at non-image areas.

* * * * *

UNITED STATES PATENT AND TRADEMARK OFFICE

CERTIFICATE OF CORRECTION

PATENT NO. : 9,176,432 B2
APPLICATION NO. : 14/623019
DATED : November 3, 2015
INVENTOR(S) : Mark Sandler It is certified that error appears in the above-identified patent and that said Letters Patent is hereby corrected as shown below:

Claims

In column 12, line 19, in Claim 11, delete “area;” and insert -- areas; --, therefor.

Signed and Sealed this
Seventh Day of June, 2016

Michelle K. Lee

Michelle K. Lee
*Director of the United States Patent and Trademark Office*